US007835681B2

(12) United States Patent
Takagi et al.

(10) Patent No.: US 7,835,681 B2
(45) Date of Patent: Nov. 16, 2010

(54) INDUCTION HEATING DEVICE AND INDUCTION HEAT FIXING DEVICE

(75) Inventors: Osamu Takagi, Chofu (JP); Satoshi Kinouchi, Shinjuku-ku (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 138 days.

(21) Appl. No.: 11/736,084

(22) Filed: Apr. 17, 2007

(65) Prior Publication Data

US 2008/0260436 A1 Oct. 23, 2008

(51) Int. Cl.
*G03G 15/20* (2006.01)
*H05B 6/36* (2006.01)

(52) U.S. Cl. ..... 399/334; 399/328; 219/672; 219/675

(58) Field of Classification Search ..... 219/216, 219/619, 672, 673, 675, 676; 399/328, 334
See application file for complete search history.

(56) References Cited

U.S. PATENT DOCUMENTS 5,752,150 A * 5/1998 Kato et al. ..... 399/330
5,819,150 A * 10/1998 Hayasaki et al. ..... 399/330
6,900,419 B2 * 5/2005 Takagi et al. ..... 219/619
7,020,426 B2 * 3/2006 Takagi et al. ..... 399/330
7,021,753 B2 * 4/2006 Sano et al. ..... 347/102
2004/0188420 A1 * 9/2004 Nishida ..... 219/619
2004/0265021 A1 * 12/2004 Kinouchi et al. ..... 399/334
2006/0210291 A1 * 9/2006 Kinouchi et al. ..... 399/67

FOREIGN PATENT DOCUMENTS

JP 09-237675 9/1997
JP 2000-215973 8/2000
JP 2002-123106 4/2002

* cited by examiner

*Primary Examiner*—David M Gray
*Assistant Examiner*—Rodney Bonnette
(74) *Attorney, Agent, or Firm*—Turocy & Watson, LLP

(57) ABSTRACT

An induction heating device of the invention is made to have a two-layer structure in which at an end of a magnetic core of an induction current generating coil, a litz wire of outside three turns is stacked on a litz wire of inside three turns. The width of a joint portion between plural induction current generating coils is made narrow, and a mutual induction current generated at the joint portion is reduced. Further, the whole length of the litz wire is shortened without changing the length of the magnetic core of the inductor current generating coil.

14 Claims, 5 Drawing Sheets

INDUCTION HEATING DEVICE AND INDUCTION HEAT FIXING DEVICE

BACKGROUND OF THE INVENTION

1. Field of the Invention

The present invention relates to an induction heating device and an induction heat fixing device, which is mounted in an image forming apparatus, such as a copier, a printer or a facsimile, includes a heating target member which is heated by induction heating, and fixes a toner image on a sheet by the heating target member.

2. Description of the Related Art

As a fixing device used for an image forming apparatus such as an electro photographic copier or printer, there is a device in which a sheet paper is inserted into a nip formed between a pair of rollers including a heat roller and a press roller or between similar belts, and a toner image is heated, pressed and fixed. In such a heating type fixing device, in order to realize speed-up of process speed, there is an induction heat fixing device in which a heat roller or a heating belt is heated by an induction heating system.

As one of such induction heat fixing devices, there is a device in which an induction current generating coil is disposed outside a heat roller having a metal conductive layer or a heating belt to be opposite thereto. In the device as stated above, an eddy-current is generated in the metal conductive layer by a magnetic field generated by supplying a specified power to the induction current generating coil. The metal conductive layer is instantaneously heated by this eddy-current, and for example, heating of the heat roller is performed. Further, in the fixing device of the induction heating system as stated above, in order to uniform the temperature distribution of the heat roller in the longitudinal direction, there is a device in which an induction current generating coil is divided into plural parts.

However, when the induction current generating coil is divided into plural parts as stated above, magnetic field at a joint portion between adjacent induction current generating coils is reduced. Thus, the temperature of the heat roller is lowered at the joint portion between the adjacent induction current generating coils, and there is a fear that temperature unevenness occurs in the heat roller. For example, as shown in the Prior Art of FIG. 1, in the case where induction current generating coils 102 and 103 in each of which a litz wire 101 including 50 enamel wires with a wire diameter of 0.3 mm is wound six turns in a simple shape are adjacent to each other, the coil width of a joint portion ($\alpha$) becomes 36 mm to 40 mm. As stated above, when the width of the joint portion to cause the reduction of magnetic field is wide, there is a fear that temperature unevenness of the heat roller becomes noticeable.

Thus, for example, JP-A-9-237675 discloses a heating device in which all ends of exciting coils provided in the inside of a heat roller are stacked, and the width of the exciting coil at the end is narrowed.

However, in the device in which the induction current generating coil is divided into the plural parts, at the joint portion between the adjacent induction current generating coils, a mutual induction current is generated between the induction current generating coils. When all coils are stacked in the induction current generating coils, the facing area of the adjacent coils at the joint portion becomes large. As a result, the mutual induction current generated between both the coils of the joint portion becomes large, and there is a fear that temperature unevenness of the heat roller occurs.

Especially, there is a device in which for further speed-up, a thinner and small heat capacity metal conductive layer is provided near the surface, and the metal conductive layer is heated by an external induction current generating coil. In such a device, a mutual induction current generated in a joint portion of induction current generating coils has a remarkable influence on temperature unevenness of the heat roller, and there is a fear that poor fixation occurs.

Then, in a heating device to heat a metal conductive layer by using induction current generating coils divided into plural parts, there is desired an induction heating device in which temperature unevenness due to a joint portion between adjacent induction current generating coils is reduced, and the temperature is made uniform. Besides, there is desired an induction heat fixing device which can obtain excellent fixing properties by using this induction heating device.

SUMMARY OF THE INVENTION

According to an aspect of the invention, in a case where a metal conductive layer is heated by using induction current generating coils divided into plural parts, temperature unevenness at a joint portion between adjacent induction current generating coils is reduced. As a result, there is provided an induction heating device in which the metal conductive layer is uniformly heated over the whole length in the longitudinal direction, and the temperature is uniform. Besides, there is provided an induction heat fixing device using the induction heating device and having uniform and excellent fixing properties.

According to an embodiment of the invention, an induction heating device is characterized by including a heating target member that is endless, having a metal conductive layer, and a plurality of induction current generating coils that are opposite to the heating target member, and are disposed to be adjacent to each other to heat different areas of the heating target member, wherein the induction current generating coils make a plurality of turns along an outer peripheral surface of the heating target member, in a direction parallel to a rotation axis direction of the heating target member, the induction current generating coils are arranged in a plane shape along the outer peripheral surface of the heating target member, and in a direction parallel to a rotation direction of the heating target member, the induction current generating coils are arranged to be stacked in a plurality of stages the number of which is not less than two and less than the number of the plurality of turns.

DETAILED DESCRIPTION OF THE PREFERRED EMBODIMENT

Figure 1:
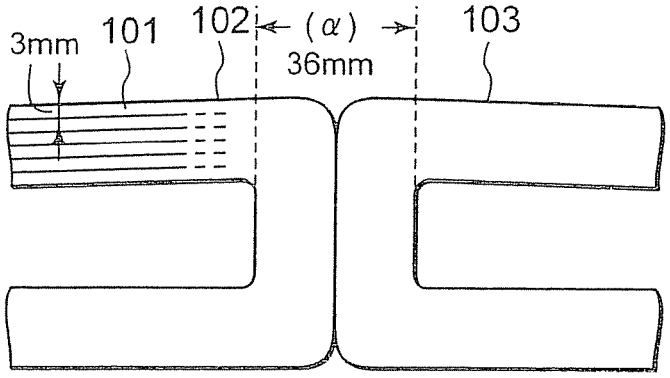
FIG. 1 PRIOR ART
FIG. 1 is a schematic explanatory view showing a joint portion between induction current generating coils of the Prior Art of the invention.
Figure 2:
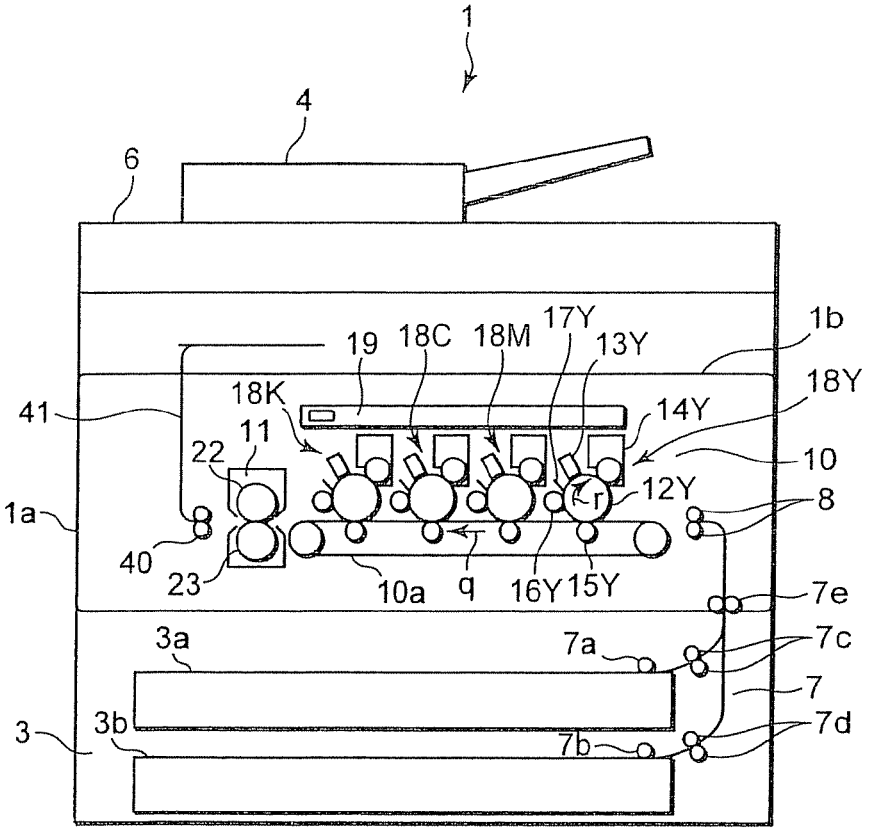
FIG. 2 is a schematic structural view showing an image forming apparatus in which a fixing device of an embodiment of the invention is mounted.

Hereinafter, embodiments of the invention will be described in detail with reference to the accompanying drawings. FIG. 2 is a schematic structural view showing an image forming apparatus 1 in which a fixing device 11, which is an induction heat fixing device of an embodiment of the invention, is mounted. A scanner unit 6 to read an original document supplied by an automatic document feeder 4 is provided at an upper surface of the image forming apparatus 1. The image forming apparatus 1 includes a cassette mechanism 3 to supply a sheet paper P, which is a medium to be fixed, to an image forming unit 10.

The cassette mechanism 3 includes first and second paper feed cassettes 3*a* and 3*b*. Pickup rollers 7*a* and 7*b* to take out a sheet paper from the paper feed cassettes 3*a* and 3*b*, separation conveyance rollers 7*c* and 7*d*, a conveyance roller 7*e* and a register roller 8 are provided along a conveyance path 7 from the paper feed cassettes 3*a* and 3*b* to the image forming unit 10. The fixing device 11 to fix a toner image formed on the sheet paper P in the image forming unit 10 is provided on the downstream side of the image forming unit 10. A paper eject roller 40 is provided on the downstream side of the fixing device 11, and a paper eject conveyance path 41 to convey the sheet paper P after fixation to a paper eject portion 1*b* is provided.

The image forming unit 10 includes image forming stations 18Y, 18M, 18C and 18K of respective colors of yellow (Y), magenta (M), cyan (C) and black (K). The image forming stations 18Y, 18M, 18C and 18K are arranged in tandem along a transfer belt 10*a* rotated in an arrow q direction.

The yellow (Y) image forming station 18Y is formed such that a charger 13Y a developing device 14Y, a transfer roller 15Y, a cleaner 16Y and a charge-removal unit 17Y, as a process member, are disposed around a photoconductive drum 12Y which is an image bearing body rotating in an arrow r direction. A laser exposure device 19 to irradiate a laser beam to the photoconductive drum 12Y is provided above the image forming station 18Y of yellow (Y).

The image forming stations 18M, 18C and 18K of the respective colors of magenta (M), cyan (C) and black (K) have the same structure as the image forming station 18Y of yellow (Y).

In the image forming unit 10, when the print operation is started, in the yellow (Y) image forming station 18Y, the photoconductive drum 12Y is rotated in the arrow r direction, and is uniformly charged by the charger 13Y. Next, the photoconductive drum 12Y is irradiated with an exposure light corresponding to image information read by the scanner unit 6 and an electrostatic latent image is formed. Thereafter, a toner image is formed on the photoconductive drum 12Y by the developing device 14Y, and at the position of the transfer roller 15Y, the toner image is transferred to the sheet paper P conveyed on the transfer belt 10*a* in the arrow q direction. After completion of the transfer, a remaining toner on the photoconductive drum 12Y is cleaned by the cleaner 16Y, the charge on the surface of the photoconductive drum 12Y is removed by the charge-removal unit 17Y, and next printing becomes possible.

In the image forming stations 18M, 18C and 18K of the respective colors of magenta (M), cyan (C) and black (K), an image forming operation is performed similarly to the image forming station 18Y of yellow (Y), and a full-color toner image is formed on the sheet paper P. Thereafter, the sheet paper P is heated, pressed and fixed by the fixing device 11 which is the induction heat fixing device, so that the print image is completed, and the sheet paper is ejected to the paper eject portion 1*b*.

Figure 3:
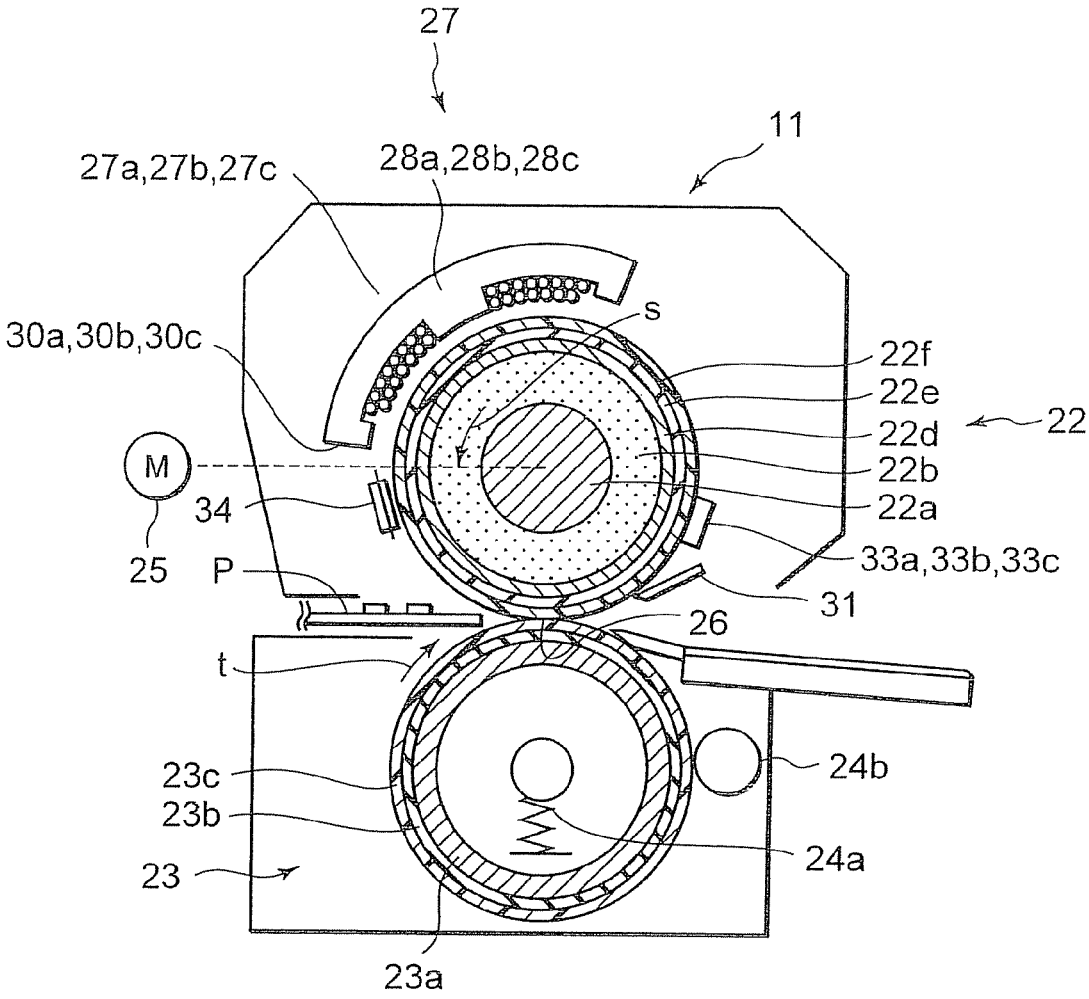
FIG. 3 is a schematic structural view showing the fixing device of the embodiment of the invention.

Next, the fixing device 11 will be described. FIG. 3 is a schematic structural view showing the fixing device 11. The fixing device 11 includes a heat roller 22 which is an endless heating target member, and a press roller 23 which is a press member. The heat roller 22 is driven in an arrow s direction by a drive motor 25. The press roller 23 is brought into press contact with the heat roller 22 by a compression spring 24*a*. By this, a nip 26 with a specific width is formed between the heat roller 22 and the press roller 23. The press roller 23 is driven by the heat roller 22 and is rotated in an arrow t direction.

Further, an induction current generating coil 27 to heat the heat roller 22 through a gap is disposed outside the heat roller 22 and opposite thereto. Further, a peel pawl 31 to prevent the sheet paper P after fixation from winding, a first thermistor 33*a*, a second thermistor 33*b* and a third thermistor 33*c*, to detect the surface temperature of the heat roller 22, and a thermostat 34 to detect the abnormality of the surface temperature of the heat roller 22 and to cut off the heating are provided around the heat roller 22. Incidentally, when there is no fear that the sheet paper P winds around the heat roller, the peel pawl 31 may not be provided. A cleaning roller 24*b* is provided at the outer periphery of the press roller 23.

The heat roller 22 includes a foamed rubber (sponge) 22*b* with a thickness of 5 to 12 mm around a cored bar 22*a*, a metal conductive layer 22*d* made of nickel (Ni) and having a thickness of 40 μm, a solid rubber layer 22*e* having a thickness of 200 μm, and a release layer 22*f* having a thickness of 30 μm. The metal conductive layer 2*c* is not limited to nickel, but may be stainless, aluminum, or compound material of stainless and aluminum.

The press roller 23 includes a cored bar 23*a*, and a silicone rubber layer 23*b* around it. The press roller 23 further includes a release layer 23*c*. Incidentally, instead of the silicone rubber layer 23*b*, a fluorine rubber layer may be used. Each of the heat roller 22 and the press roller 23 is formed to have a diameter of 40 mm. The sheet paper P passes through the nip 26 between the heat roller 22 and the press roller 23 as stated above, so that a toner image on the sheet paper P is heated, pressed and fixed.

Incidentally, the press roller 23 may include a metal conductive layer heated by an induction current generating coil, or may have a built-in halogen lamp heater as the need arises.

Next, the induction current generating coil 27 will be described. The induction current generating coil 27 includes the first to the third induction current generating coils 27*a*, 27*b* and 27*c*. Magnetic cores 28*a*, 28*b* and 28*c* of the first to the third induction current generating coils 27*a*, 27*b* and 27*c* are almost coaxial with the heat roller 22. The magnetic core 28 concentrates the magnetic flux generated by the induction current generating coil 27 to the heat roller 22. Magnetic shield materials 30*a*, 30*b* and 30*c* are provided to protrude at both sides of the magnetic cores 28*a*, 28*b* and 28*c*, and can further concentrate the magnetic flux to the heat roller 22.

Figure 4:
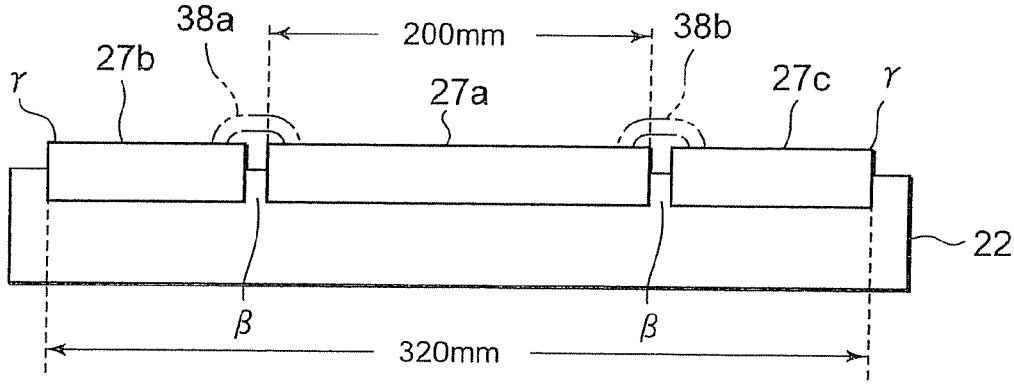
FIG. 4 is a schematic explanatory view showing an induction current generating coil of the embodiment of the invention.

As shown in FIG. 4, the first induction current generating coil 27*a* has a length of 200 mm, and heats the center area of the heat roller 22. Besides, at the joint portions (β) between the first to the third induction current generating coils 27*a*, 27*b* and 27*c* bridge cores 38*a* and 38*b* are bridged. The bridge cores 38*a* and 38*b* concentrate the magnetic flux of the joint portions (β) between the first to the third induction current generating coils 27*a*, 27*b* and 27*c* to the metal conductive layer 22*d*, and can improve the heat generation efficiency of the metal conductive layer 22. The second and the third induction current generating coils 27*b* and 27*c* are disposed at both sides of the first induction current generating coil 27*a*. The second and the third induction current generating coils 27*b* and 27*c* are connected in series, and are driven by the same control. The whole length of 320 mm of the heat roller 22 is heated by the first to the third induction current generating coils 27*a*, 27*b* and 27*c*. The first induction current generating coil 27*a* and the second and the third induction current generating coils 27*b* and 27*c* are alternately switched over to make outputs. Incidentally, the first induction current generating coil 27*a* and the second and the third induction current generating coils 27*b* and 27*c* may simultaneously make outputs.

When a high frequency current is applied, the induction current generating coil 27 generates a magnetic flux. By this magnetic flux, an eddy-current is generated in the heat roller 22 so as to prevent the change of the magnetic field. The Joule heat is generated in the metal conductive layer 22*d* by this eddy-current and the resistance of the heat roller 22, and the heat roller 22 is heated.

For example, the induction current generating coil 27 uses a litz wire made of plural twisted copper wires and having a wire diameter of 3 mm. As an insulating material of the copper wire, heat-resistant polyamide-imide is used. The wire and insulating material are not limited to these, and the wire diameter is also arbitrary. In the case where the litz wire is used, its structure is also arbitrary, and plural insulating copper wires may be simply bundled, and the number of copper wires and the thickness are also not limited. The induction current generating coil 27 is formed such that the litz wire is wound around the magnetic cores 28*a*, 28*b* and 28*c*.

Figure 5:
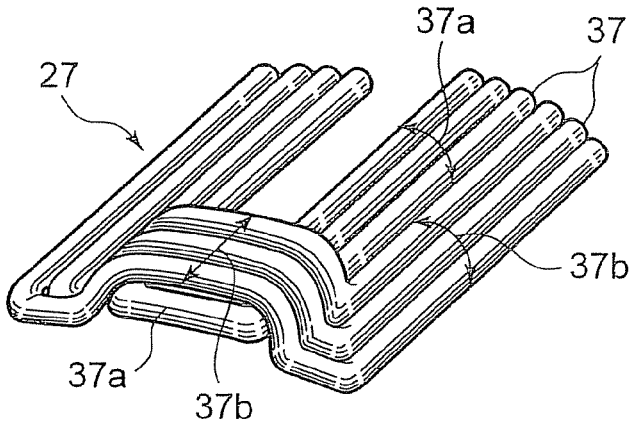
FIG. 5 is a partial perspective view showing a state of an end of the induction current generating coil of the embodiment of the invention, in which a magnetic core is removed.
Figure 6:
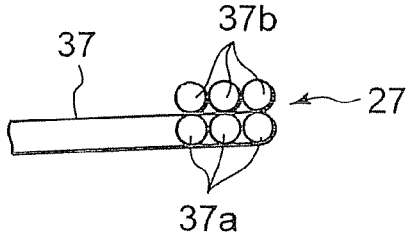
FIG. 6 is an explanatory view showing a state in which litz wires are stacked in two layers at the end of the induction current generating coil of the embodiment of the invention.

For example, in the case where the induction current generating coil 27 is formed by making six turns of the litz wire 37, at the ends of the magnetic cores 28*a*, 28*b* and 28*c*, as shown in FIG. 5 and FIG. 6, the litz wire 37 is stacked and arranged. That is, in the longitudinal direction of the heat roller 22 parallel to the rotation axis direction of the heat roller 22, the litz wire is not stacked but is simply wound. By this, in the longitudinal direction of the heat roller 22, the induction current generating coil 27 is formed to have a plane shape substantially parallel to the surface of the heat roller 22.

On the other hand, at the end extending in a direction parallel to the rotation direction of the heat roller 22, the litz wire 37 is formed in two layers. The two layers are formed such that three outside turns 37*b* as a second portion are stacked on three inside turns 37*a* as a first portion.

Figure 7:
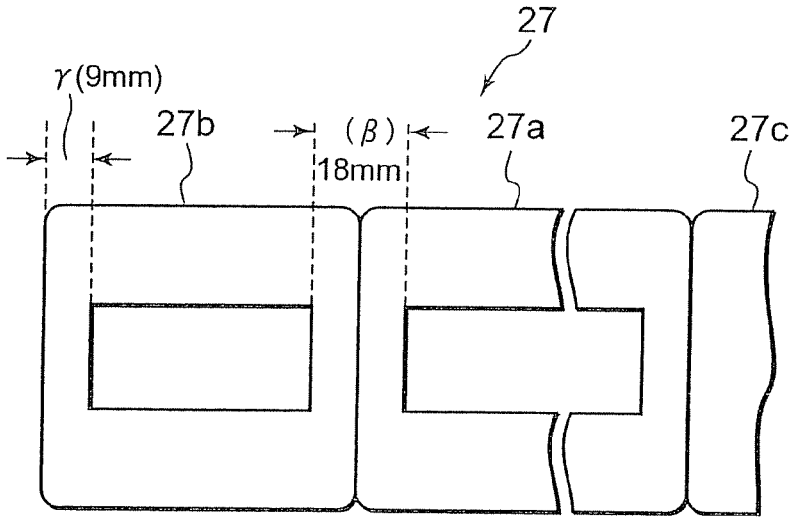
FIG. 7 is a schematic explanatory view showing a joint portion between the induction current generating coils of the embodiment of the invention.

By stacking the litz wire 37 in the two layers as stated above, the widths of adjacent joint portions (β) of the first to the third induction current generating coils 27*a*, 27*b* and 27*c* and both ends (γ) become narrow. As shown in FIG. 7, when the litz wire 37 has a wire diameter of 3 mm, the coil widths of both the ends (γ) are respectively equal to 3 turns (3×3=9 mm), and the joint portion (β) comes to have the coil width of 18 mm in total. Accordingly, as compared with the case where the litz wire 37 is not stacked and a simple shape is adopted, the coil width of each of the joint portion (β) and both the ends (γ) can be reduced to ½. As a result, the temperature lowering of the metal conductive layer 22*d* at the adjacent joint portion (β) and both the end (γ) can be reduced, and the temperature unevenness of the heat roller 22 can be reduced.

Further, the facing area between the first to the third induction current generating coils 27*a*, 27*b* and 27*c* at the joint portion (β) is equivalent to only two layers of the litz wire 37 and becomes narrow. Accordingly, as compared with the case where all litz wires 37 are stacked, the mutual induction current generated at the joint portion (β) between the adjacent first to third induction current generating coils 27*a*, 27*b* and 27*c* can be reduced. As a result, the temperature lowering of the metal conductive layer 22*d* due to the mutual induction current at the joint portion (β) can be reduced, and the temperature unevenness of the heat roller 22 can be reduced.

Further, when the litz wire 37 is stacked in two layers as stated above, the whole length of the litz wire 37 can be shortened without changing the length of the induction current generating coil 27 in the longitudinal direction (length of the magnetic cores 28*a*, 28*b* and 28*c*). As a result, at the time of current generation, wasteful Joule heat due to copper loss of the litz wire 37 can be reduced, and the heat generation efficiency of the metal conductive layer 22*d* can be raised.

Figure 8:
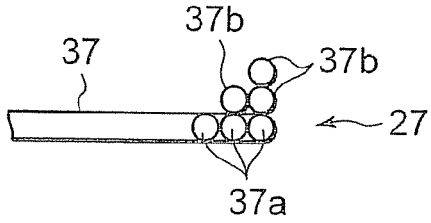
FIG. 8 is an explanatory view showing a state in which litz wires are stacked in three layers at the end of the induction current generating coil of the embodiment of the invention.

Incidentally, the stacking of the litz wires 37 at the end of the heat roller 22 in the direction parallel to the rotation direction is not limited to the two layers. For example, as shown in FIG. 8, three outside turns 37*b* are divided into two layers and are stacked on three inside turns 37*a* so that three layers in total may be formed. Further, in the case where the number of turns of the induction current generating coil 27 is large, the number of layers to be stacked can be increased. Besides, the way of stacking when the litz wire is further stacked is also arbitrary. However, as the magnetic flux of the litz wire 37 becomes close to the metal conductive layer 22*d*, the heat generation effect is increased. Accordingly, it is more suitable that the number of stacked litz wires at the end is two to three.

Figure 9:
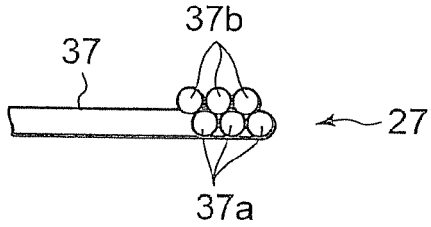
FIG. 9 is an explanatory view showing a state in which litz wires are stacked into bales at the end of the induction current generating coil of the embodiment of the invention.

When the first to the third induction current generating coils 27*a*, 27*b* and 27*c* are respectively wound around the magnetic cores 28*a*, 28*b* and 28*c*, for example, as shown in FIG. 9, three outside turns 37*b* are overlapped on three inside turns 37*a* in a bale stacking form. The bale stacking is such a form that the litz wires 37*b* of the second layer are stacked so as to be fitted in grooves between the litz wires 37*a* of the first layer. When the bale stacking is performed as stated above, as compared with simple stacking, the stacking height of the litz wires 37 can be made lower.

When the stacking height of the litz wire 37 is made lower, the whole length of the litz wire 37 can be further shortened without changing the length of the induction current generating coil 27 in the longitudinal direction. When the bale stacking is performed, as compared with the case of simple stacking, wasteful Joule heat due to copper loss of the litz wire 37 can be reduced by the shortening of the litz wire 37, and the heat generation efficiency of the metal conductive layer 22*d* can be raised.

Figure 10:
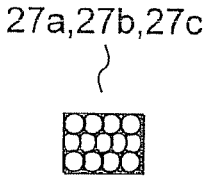
FIG. 10 is an explanatory view showing a state in which litz wires are pressed at the end of the induction current generating coil of the embodiment of the invention.
Figure 11:
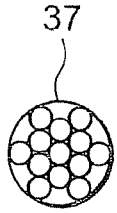
FIG. 11 is an explanatory view showing a sectional shape of a litz wire of the embodiment of the invention.

Alternatively, at the time when the first to the third induction current generating coils 27*a*, 27*b* and 27*c* are respectively wound around the magnetic cores 28*a*, 28*b* and 28*c*, the ends of the induction current generating coils 27*a*, 27*b* and 27*c* are pressed, for example, as shown in FIG. 10. In general, the section of the litz wire 37 is round as shown in FIG. 11. When the litz wire 37 is pressed and the section is made rectangular as shown in FIG. 10, as compared with the litz wire 37 with the round section, the stacking height of the litz wire 37 can be made lower.

When the stacking height of the litz wire 37 is made lower, the whole length of the litz wire 37 can be further shortened without changing the length of the induction current generating coil 27 in the longitudinal direction. When the litz wire 37 is pressed, as compared with the case where the litz wire 37 with the round section is stacked, wasteful Joule heat due to copper loss of the litz wire 37 can be reduced by the shortening of the litz wire 37, and the heat generation efficiency of the metal conductive layer 22*d* can be raised.

When the ends of the induction current generating coils 27*a*, 27*b* and 27*c* are pressed, the litz wire 37 is inserted into a press molding machine, and the pressed litz wire may be stacked. Alternatively, after the three outside turns 37*b* are stacked on the three inside turns 37*a*, the whole may be press molded.

Figure 12:
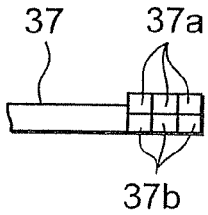
FIG. 12 is an explanatory view showing a state in which an inside peripheral litz wire is stacked on an outside peripheral litz wire at the end of the induction current generating coil of the embodiment of the invention.

At the ends of the induction current generating coils 27*a*, 27*b* and 27*c*, as shown in FIG. 12, with respect to the litz wire 37, the three inside turns 37*a* may be stacked on the three outside turns 37*b*. This is formed such that after the three inside turns 37*a* are wound, the three outside turns 37*b* are wound under the three inside turns 37*a*. At this time, for example, after the three inside turns 37*a* are wound, first, the three inside turns 37*a* are press molded. Next, the three outside turns 37*b* are wound and are further press molded.

Figure 13:
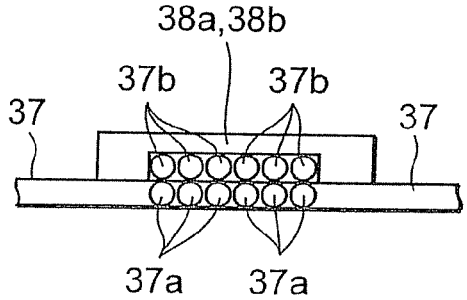
FIG. 13 is a schematic explanatory view showing a state in which a bridge core is bridged across a joint portion between the induction current generating coils of the embodiment of the invention.

Besides, at the joint portions (β) between the first to the third induction current generating coils 27*a*, 27*b* and 27*c*, for example, as shown in FIG. 13, bridge cores 38*a* and 38*b* are bridged. The bridge cores 38*a* and 38*b* concentrate the magnetic flux of the joint portions (β) between the first to the third induction current generating coils 27*a*, 27*b* and 27*c* to the metal conductive layer 22*d*, and can improve the heat generation efficiency of the metal conductive layer 22*d*. With respect to the induction current generating coil 27, the bridge cores 38*a* and 38*b* may not be bridged across the joint portions (β). However, in the case where the bridge cores 38*a* and 38*b* are provided, as compared with the case where the bridge cores 38*a* and 38*b* are not disposed, the metal conductive layer 22*d* can be more efficiently heated at the joint portions (β). Accordingly, the temperature lowering of the metal conductive layer 22*d* is reduced at the joint portions (β) of the induction current generating coil 27, and the temperature of the heat roller 22 can be made more uniform.

The heat roller 22 is heated by the induction current generating coil 27 having the above structure. Here, the first thermistor 33*a* detects the temperature of the center portion of the heat roller 22 heated by the first induction current generating coil 27*a*, the second thermistor 33*b* detects the temperature of the heat roller 22 heated by the second induction current generating coil 27*b*, and the third thermistor 33*c* detects the temperature of the heat roller 22 heated by the third induction current generating coil 27*c*.

Figure 14:
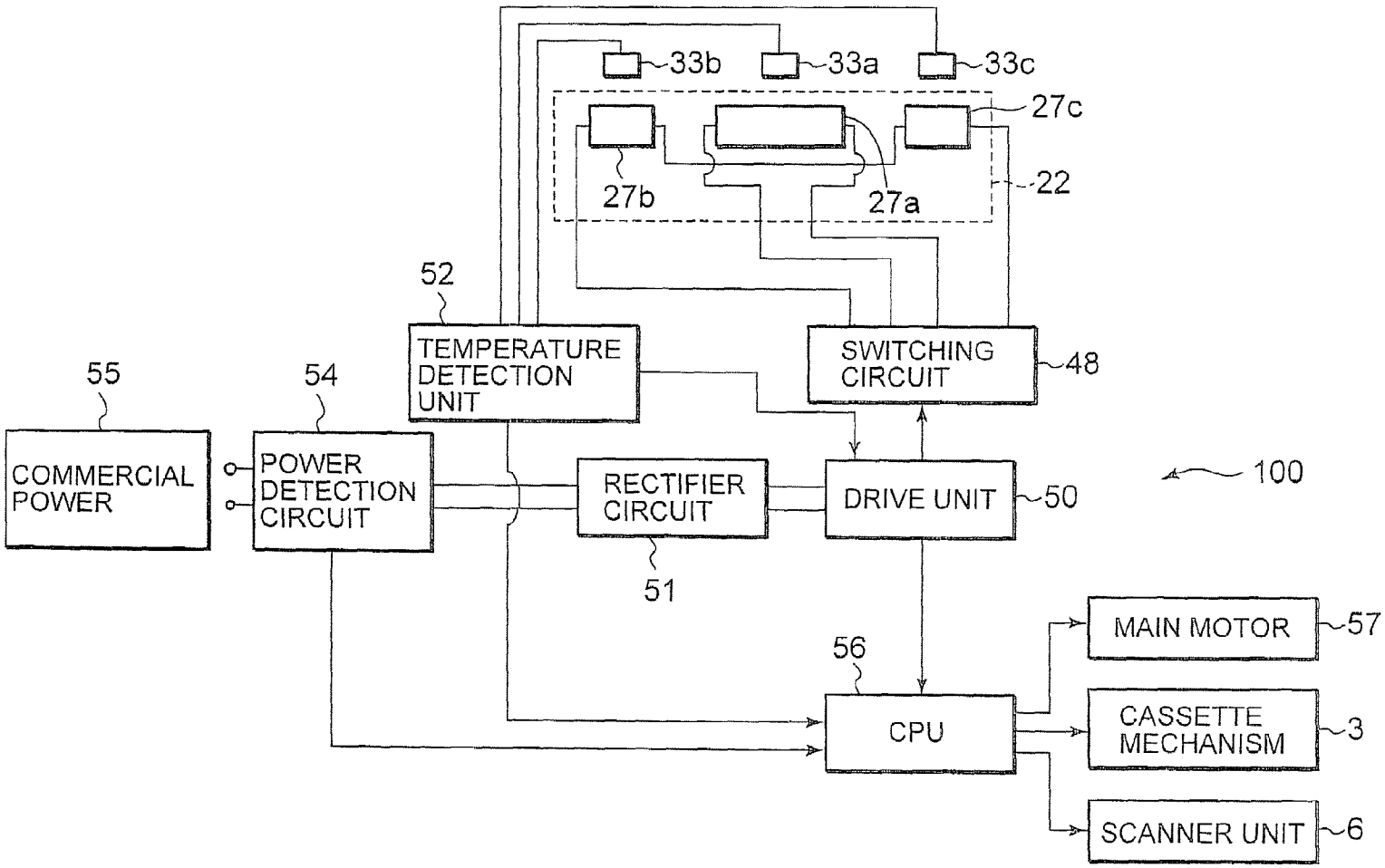
FIG. 14 is a block diagram showing a control unit of a fixing device of an embodiment of the invention.

Next, a control system 100 of the fixing device 11 will be described with reference to a block diagram of FIG. 14. The control system 100 controls variably a high frequency power supplied to the induction current generating coil 27 to heat the heat roller 22.

The control system 100 includes a switching circuit 48 to supply a drive current to the first induction current generating coil 27*a* or the second and the third induction current generating coils 27*b* and 27*c*, a drive unit 50 to supply a control signal to the switching circuit 48, a rectifier circuit 51 to supply 100V DC power to the drive unit 50, a temperature detecting unit 52 connected to the first to the third thermistors 33*a* to 33*c*, and a CPU 56 to control the whole image forming apparatus 1 and to control the drive unit 50 according to the detection result of the temperature detecting unit 52.

The CPU 56 controls the amount of power outputted from the switching circuit 48 to the first to the third induction current generating coils 27*a* to 27*c* according to the detection result of the temperature detecting unit 52. By this, the heating temperature of the heat roller 22 is adjusted. The CPU 56 controls a main motor 57 of the image forming apparatus 1, the cassette mechanism 3 and the scanner unit 6. Further, in the case where a finisher 58 or a large capacity paper feed device 60 is provided as an option, the CPU 56 controls the finisher 58 or the large capacity paper feed device 60. The power consumption of the main motor 57 of the image forming apparatus 1, the paper feed device 3 and the scanner 4 is, for example, about 200 W, the power consumption of the finisher 58 is, for example, about 100 W, and the power consumption of the large capacity paper feed device 60 is, for example, about 100 W.

The rectifier circuit 51 rectifies a current from a commercial AC power 55 to 100 V, and supplies it to the drive unit 50. A power detection circuit 54 is provided between the commercial AC power 55 and the input end of the rectifier circuit 51. The power detection circuit 54 always monitors power supplied to the first to the third induction current generating coils 27*a* to 27*c*. The monitor result by the power detection circuit 54 is fed back to the drive unit 50 and the CPU 56 at a specified timing.

The control system 100 uses the power detection circuit 54 to perform monitoring so that the power consumption of the image forming apparatus 1 including the fixing device 11 does not exceed the power rated value. That is, in the case where the commercial power is used, the power rated value usable in the whole image forming apparatus 1 is determined to be 1500 W. Accordingly, the power detection circuit 54 performs monitoring so that the usable power consumption for the fixing device 11 becomes at most the amount of power obtained by subtracting the amount of power used for the drive source such as the main motor 57 and the amount of power used for the option function such as the finisher 58 from 1500 W. The power detection circuit 54 obtains the power consumption used for something other than the fixing device 11, such as the main motor 57 or the option function, by integrating an input current flowing into each mechanism and a voltage.

Next, the operation will be described. In the image forming unit 10, when the image forming process starts, in the image forming stations 18Y, 18M, 18C and 18K of the respective colors of yellow (Y), magenta (M), cyan (C) and black (K), toner images are respectively formed on the photoconductive drums 12Y, 12M, 12C and 12K. The toner images on the photoconductive drums 12Y, 12M, 12C and 12K are transferred to the sheet paper P on the transfer belt 10*a* rotated in the arrow q direction by the transfer rollers 15Y, 15M, 15C and 15K, and a full-color toner image is formed on the sheet paper P. Thereafter, the sheet paper P passes through the nip 26 between the heat roller 22 and the press roller 23 of the fixing device 11, the toner image is heated, pressed and fixed, and the print image is completed.

In the fixing device 11, when the image formation process starts, the heat roller 22 is driven by the drive motor 25 in the arrow s direction, and the press roller 23 driven by this is rotated in the arrow t direction. Further, in the fixing device 11, the CPU 56 controls the drive unit 50 in accordance with the detection result of the surface temperature of the heat roller 22 from the thermistors 33*a* to 33*c*.

The drive unit 50 supplies a power of 900 W to the first induction current generating coil 27*a* and/or the second and the third induction current generating coils 27*b* and 27*c* according to the size of the sheet paper P. When the size of the sheet paper P is a full size such as, for example, A4 lateral size (210×297 mm) according to JIS standards or A3 size (420×297 mm), the fixing device 11 supplies the power to the first induction current generating coil 27*a* and the second and the third induction current generating coils 27*b* and 27*c*, and heats the whole length of the heat roller 22 in the longitudinal direction. Besides, when the size of the sheet paper P is small such as, for example, A4 vertical size (297×210 mm) according to JIS standards, the fixing device 11 supplies the power only to the first induction current generating coil 27*a*, and heats a part of the center of the heat roller 22. By this, the induction current generating coil 27 raises the temperature of a necessary portion of the heat roller 22 at a high speed of about 10 seconds to, for example, a fixing temperature of 160° C., and enables fixing.

At this time, the induction current generating coil 27 formed by making six turns of the litz wire 37 has the two-layer structure in which at the ends of the magnetic cores 28*a*, 28*b* and 28*c*, the litz wire 37 of the three outside turns 37*b* is stacked on the litz wire 37 of the three inside turns 37*a*. That is, the widths of the adjacent joint portion (β) between the first to the third induction current generating coils 27*a*, 27*b* and 27*c* and both ends (γ) become narrow to be about ½ as compared with the coil of the simple shape in which the litz wire 37 is not stacked. Besides, at the same time, at the joint portion (β), the facing area between the first to the third induction current generating coils 27*a*, 27*b* and 27*c* is reduced as compared with the case where all litz wires 37 are stacked. Further, the whole length of the litz wire 37 is shortened without changing the length of the magnetic cores 28*a*, 28*b* and 28*c* of the induction current generating coil 27.

From this, in the case where the whole length of the heat roller 22 in the longitudinal direction is heated, the temperature lowering of the metal conductive layer 22*d* due to the coil widths of the adjacent joint portion (β) of the induction current generating coil 27 and both ends (γ) can be reduced. Besides, the temperature lowering of the metal conductive layer 22*d* due to the mutual induction current generated at the joint portion (β) of the induction current generating coil 27 can also be reduced. Further, in the first to the third induction current generating coils 27*a*, 27*b* and 27*c*, the litz wire 37 is stacked in two layers at the ends of the magnetic cores 28*a*, 28*b* and 28*c*.

That is, the stacked portions of the first to the third induction current generating coils 27*a*, 27*b* and 27*c* are also relatively close to the heat roller 22. Accordingly, the magnetic field generated in the stacked portions of the first to the third induction current generating coils 27*a*, 27*b* and 27*c* can be made to be exerted on the heat roller 22. Accordingly, such temperature unevenness that the temperature of the heat roller 22 is lowered at the joint portion (β) of the induction current generating coil 27 can be reduced, and the temperature can be made more uniform over the whole length of the heat roller 22. Besides, wasteful Joule heat due to the copper loss of the litz wire 37 can be reduced by shortening of the litz wire 37, and the heat generation efficiency of the metal conductive layer 22*d* can be raised.

On the other hand, as a comparative example, in the case where the end of an induction heating coil wound in a simple shape is simply bent, the outer peripheral portion far from the heat roller 22 becomes excessively apart from the heat roller 22. Thus, in the case of the induction heating coil in which the simple shape end is bent, the magnetic field generated in the outer peripheral portion of the bent end can not be made to be exerted on the heat roller 22.

Besides, when the litz wire 37 is made to have the two-layer structure by the bale stacking at the end of the induction current generating coil 27, the stacking height of the litz wire 37 can be further reduced. Alternatively, when the litz wire 37 is pressed at the end of the induction current generating coil 27, the stacking height of the two-layer structure can be further reduced.

From this, the whole length of the litz wire 37 can be further shortened. Accordingly, wasteful Joule heat due to the copper loss of the litz wire 37 can be further reduced, and the heat generation efficiency of the metal conduction layer 22*d* can be further raised.

Further, when the bridge cores 38*a* and 38*b* are bridged across the joint portions (β) of the induction current generating coil 27, the heat generation efficiency of the metal conductive layer 22*d* at the joint portions (β) of the induction current generating coil 27 can be raised. From this, the temperature lowering of the metal conductive layer 22*d* can be reduced at the joint portions (β) of the induction current generating coil 27, and the temperature can be made more uniform over the whole length of the heat roller 22.

While the heating, pressing and fixing operation is being performed in the fixing device 11 as stated above, the drive unit 50 drives the switching circuit 46, and controls the amount of power outputted to the first to the third induction current generating coils 27*a* to 27*c* according to the detection result of the temperature detection unit 52. By this, the temperature distribution of the heat roller 22 in the longitudinal direction is kept constant. Accordingly, excellent fixing properties can be always obtained over the whole length of the heat roller 22 in the longitudinal direction.

Incidentally, this invention is not limited to the above embodiment, and can be variously modified within the scope of the invention, and for example, the endless heating target member may be a fixing belt, and the number of turns of the induction current generating coil is not limited. Further, the way of stacking the induction current generating coil in the direction parallel to the heating target member, the number of stages and the like are also arbitrary.

What is claimed is:

1. An induction heating device comprising:

a heating target member that is endless, having a metal conductive layer;

a first core member which is provided outside the heating target member;

a second core member which is provided outside the heating target member and is arranged next to the first core member in a rotation axis direction of the heating target member;

a first coil which winds around the first core member that includes a first portion which is closer to the first core member and a second portion which is provided outside of the first portion, the first portion and the second portion cover the heating target member in a plane shape at a position parallel to the rotation axis direction, and the first portion covers the heating target member in a plane shape and the second portion overlaps the first portion in a plane shape at a facing position to the second core member; and a second coil which winds around the second core member.

2. The induction heating device according to claim 1, wherein an overlap portion of the second portion consists of more than two coils at least.

3. The induction heating device according to claim 2, wherein the second coil includes a first portion which is closer to the first core member and a second portion which is provided outside of the first portion, the first portion and the second portion cover the heating target member in a plane shape at a position parallel to the rotation axis direction, and the first portion covers the heating target member in a plane shape and the second portion overlaps the first portion in a plane shape at a facing position to the first core member.

4. The induction heating device according to claim 3, wherein the overlap portion of the second portion consists of more than two coils at least.

5. The induction heating device according to claim 1, wherein turns of the first portion are N turns and turns of the second portion are N turns.

6. The induction heating device according to claim 1, wherein an overlapped portion of the first coil is pressed and overlapped portion of the second coil is pressed.

7. The induction heating device according to claim 1, further comprising a bridge core which is bridged between the first coil and the second coil.

8. An induction heat fixing device comprising:

a heating target member that is endless, having a metal conductive layer;

a first core member which is provided outside the heating target member;

a second core member which is provided outside the heating target member and is arranged next to the first core member in a rotation axis direction of the heating target member;

a first coil which winds around the first core member that includes an inside turned coil member which is closer to the first core member and an outside turned coil member which is provided outside of the inside turned coil member, the inside turned coil member and the outside turned coil member cover the heating target member in a plane shape at a position parallel to the rotation axis direction, and the inside turned coil member covers the heating target member in a plane shape and the outside turned coil member overlaps the inside turned coil member in a plane shape at a facing position to the second core member; and a second coil winds around the second core member.

9. The induction heating device according to claim 8, wherein an overlap portion of the outside turned coil member consists of more than two coils at least.

10. The induction heating device according to claim 9, wherein the second coil includes an inside turned coil member which is closer to the first core member and an outside turned coil member which is provided outside of the inside turned coil member, the inside turned coil member and the outside turned coil member cover the heating target member in a plane shape at a position parallel to the rotation axis direction, and the inside turned coil member covers the heating target member in a plane shape and the outside tuned coil member overlaps the inside turned coil member in a plane shape at a facing position to the first core member.

11. The induction heating device according to claim 10, wherein the overlap portion of the outside turned coil member consists of more than two coils at least.

12. The induction heating device according to claim 8, wherein turns of the inside turned coil member are N turns and turns of the outside turned coil member are N turns.

13. The induction heating device according to claim 8, wherein overlapped portion of the first coil is pressed and overlapped portion of the second coil is pressed.

14. The induction heating device according to claim 8, further comprising a bridge core which is bridged between the first coil and the second coil.

* * * * *